US008641172B2

(12) United States Patent
Muraoka et al.

(10) Patent No.: US 8,641,172 B2
(45) Date of Patent: Feb. 4, 2014

(54) LIQUID DISCHARGE HEAD

(75) Inventors: Chiaki Muraoka, Kawaguchi (JP); Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 13/327,444

(22) Filed: Dec. 15, 2011

(65) Prior Publication Data

US 2012/0162318 A1 Jun. 28, 2012

(30) Foreign Application Priority Data

Dec. 28, 2010 (JP) ..... 2010-293008

(51) Int. Cl.
*B41J 2/04* (2006.01)
*B41J 2/15* (2006.01)
*B41J 2/145* (2006.01)

(52) U.S. Cl.
USPC ..... 347/54; 347/40

(58) Field of Classification Search
None
See application file for complete search history.

(56) References Cited

U.S. PATENT DOCUMENTS 7,118,193 B2 * 10/2006 Kaneko et al. ..... 347/43
7,591,537 B2 * 9/2009 Tsuchii et al. ..... 347/43

FOREIGN PATENT DOCUMENTS

JP 2008-055915 A 3/2008

* cited by examiner

*Primary Examiner* — Lisa M Solomon
(74) *Attorney, Agent, or Firm* — Canon USA Inc IP Division

(57) ABSTRACT

A liquid discharge head includes first and second element substrates including: a discharge port array; energy generating elements; and electric contacts electrically connected to the energy generating elements and including first and second electric contacts disposed linearly along one end and the other end. The first and second element substrates are configured such that a distance between the gravity center of the first electric contact and that of a discharge port provided at an end of the discharge port array on the first electric contacts side is different from a distance between the gravity center of the second electric contact and that of a discharge port provided at an end of the discharge port array on the second electric contacts side. The first electric contacts of the first element substrate and the second electric contacts of the second element substrates are disposed linearly, and vice versa.

10 Claims, 12 Drawing Sheets

LIQUID DISCHARGE HEAD

BACKGROUND OF THE INVENTION

1. Field of the Invention

The present invention relates to a liquid discharge head that discharges a liquid.

2. Description of the Related Art

The number of discharge port arrays in an inkjet recording head (hereinafter also referred to as a "recording head") serving as a liquid discharge head and the number of discharge ports per discharge port array have been increasing.

A large number of discharge ports enable faster recording, and a large number discharge port arrays corresponding to a large number of colors enable high quality recording. In addition, a plurality of types of discharge ports that discharge different amounts of ink may be provided. This also enables fast and high quality recording. Further, discharge port arrays for a plurality of colors may be disposed such that the order of colors of the discharge port arrays is line-symmetric with respect to the scanning direction of the recording head. This enables color inks to be overlaid in the same order between two directions during two-way recording, which enables fast and high quality recording. Moreover, as disclosed in Japanese Patent Laid-Open No. 2008-55915, a plurality of discharge port arrays may be disposed such that discharge ports in a discharge port array are interpolated by discharge ports in another discharge port array. This allows the discharge ports to be disposed with a high density, which enables high quality recording.

Along with an increase in number of discharge port arrays per recording element substrate and number of discharge ports per discharge port array, however, the size of each recording element substrate may be increased to incur an increase in manufacturing cost. Such an increase is caused by the following reasons.

Normally, recording element substrates are manufactured by forming a plurality of recording element substrates on a single wafer and cutting the wafer into separate recording element substrates. In general, the wafer has a generally circular shape. Therefore, in cutting the wafer into rectangular recording element substrates, an increase in size of the recording element substrates reduces the degree of freedom in the layout of the recording element substrates, which reduces the proportion of the use area of the wafer to the total area of the wafer. In the event that a defect occurs in the recording element substrates during manufacture, the recording element substrates are discarded in the unit of chip even if the defect is local. Therefore, the amount of loss may be increased as the size of the recording element substrates is larger.

Thus, in order to prevent an increase in manufacturing cost, it is desired to prevent an increase in size of the recording element substrates.

To prevent an increase in size of the recording element substrates, a plurality of divided recording element substrates may be mounted on a recording head. In this case, a plurality of divided recording element substrates with the same configuration may be used, which enables a further reduction in manufacturing cost.

In the case where a plurality of recording element substrates with the same configuration are disposed such that discharge ports in discharge port arrays provided on a recording element substrate are interpolated by discharge ports in discharge port arrays provided on another recording element substrate in order to dispose discharge ports with a high density, the following issues may be encountered.

That is, since recording element substrates with the same configuration are disposed such that a recording element substrate is displaced with respect to another recording element substrate, electric contacts provided on the plurality of recording element substrates may be displaced between the recording element substrates. This may cause variations in strength of joint between the plurality of electric contacts and a plurality of leads provided to a wiring member. In order to reduce such variations, it may be necessary to adjust the lengths of the leads in accordance with the positions of the electric contacts.

SUMMARY OF THE INVENTION

The present invention provides a liquid discharge head on which a plurality of recording element substrates are mounted such that discharge ports in discharge port arrays on a recording element substrate are interpolated by discharge ports in discharge port arrays on another recording element substrate, and in which variations in positions of electric contacts between the recording element substrates can be reduced.

According to an aspect of the present invention, there is provided a liquid discharge head including a first element substrate and a second element substrate. The first element substrate and the second element substrate include: a discharge port array in which a plurality of discharge ports that discharge a liquid are disposed; a plurality of energy generating elements that generate energy for discharging the liquid from the plurality of discharge ports; and a plurality of electric contacts electrically connected to the plurality of energy generating elements. The plurality of electric contacts include a plurality of first electric contacts disposed linearly along one end of the first element substrate and the second element substrate in a direction of arrangement in which the plurality of discharge ports are disposed, and a plurality of second electric contacts disposed linearly along the other end of the first element substrate and the second element substrate in the direction of arrangement. The first element substrate and the second element substrate are configured such that a distance between a center of gravity of the first electric contacts and a center of gravity of the discharge port provided at an end portion of the discharge port array on a side of the first electric contacts in the direction of arrangement is different from a distance between a center of gravity of the second electric contacts and a center of gravity of the discharge port provided at an end portion of the discharge port array on a side of the second electric contacts in the direction of arrangement. The plurality of first electric contacts of the first element substrate and the plurality of second electric contacts of the second element substrate are disposed linearly, and the plurality of second electric contacts of the first element substrate and the plurality of first electric contacts of the second element substrate are disposed linearly.

In a liquid discharge head on which a plurality of recording element substrates are mounted such that discharge ports in discharge port arrays on a recording element substrate are interpolated by discharge ports in discharge port arrays on another recording element substrate, variations in positions of electric contacts between the recording element substrates can be reduced.

Further features of the present invention will become apparent from the following description of exemplary embodiments with reference to the attached drawings.

DESCRIPTION OF THE EMBODIMENTS

First Embodiment

Figure 2:
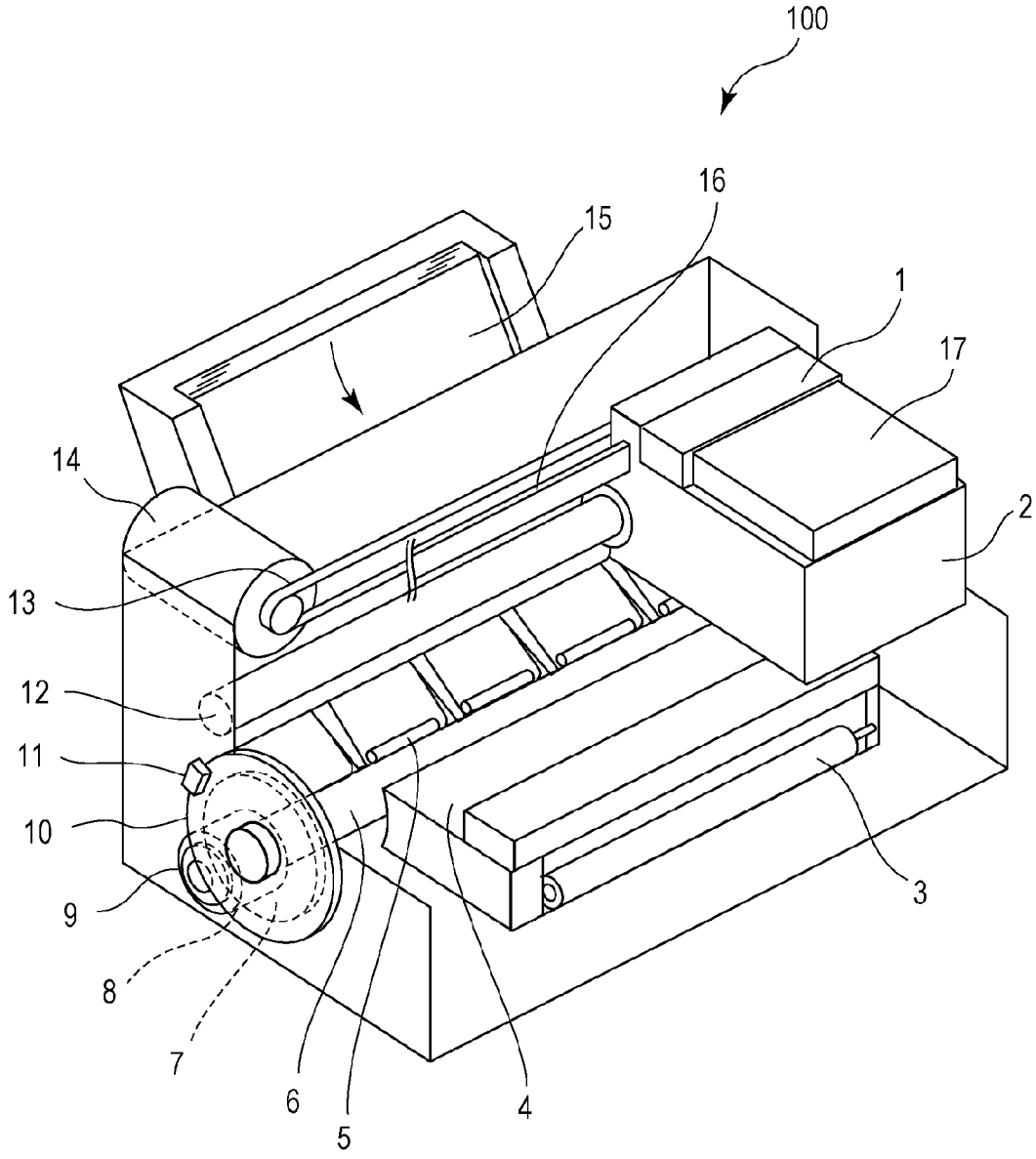
FIG. 2 shows a recording device on which the inkjet recording head according to the present invention is mounted.

First, the main configuration of an inkjet recording device 100 (hereinafter referred to as a "recording device") on which an inkjet recording head 1 (hereinafter referred to as a "recording head") is mounted will be described with reference to FIG. 2. The recording head 1 serves as a liquid discharge head to which the present invention can be applied.

The recording head 1 includes a nozzle array including a plurality of nozzles that discharge ink. The recording head 1 is mounted on a carriage 2, which is mounted on a shaft 12 to perform scanning in the scanning direction which is orthogonal to the direction in which a recording medium 15 is conveyed. The carriage 2 is driven by a motor 14 via a belt 13 to perform scanning. A carriage position sensor (not shown) detects a carriage encoder 16 to detect the position of the carriage 2.

When a recording operation is started, the recording medium 15, which may be paper, is conveyed by a paper feed roller 6 driven by a paper feed motor 8. A sensor 11 detects a slit provided in a paper feed encoder 10 that rotates in sync with the paper feed motor 8 to detect the position of the recording medium 15.

After recording is performed using ink discharged from the recording head 1, the recording medium 15 is conveyed out of the recording device 100 along with rotation of a paper eject roller 3.

Ink is discharged onto a predetermined position of the recording medium 15 by controlling the timings of drive of the recording head 1, which discharges ink from discharge ports, scanning of the carriage 2, and conveyance of the recording medium 15.

Figure 3:
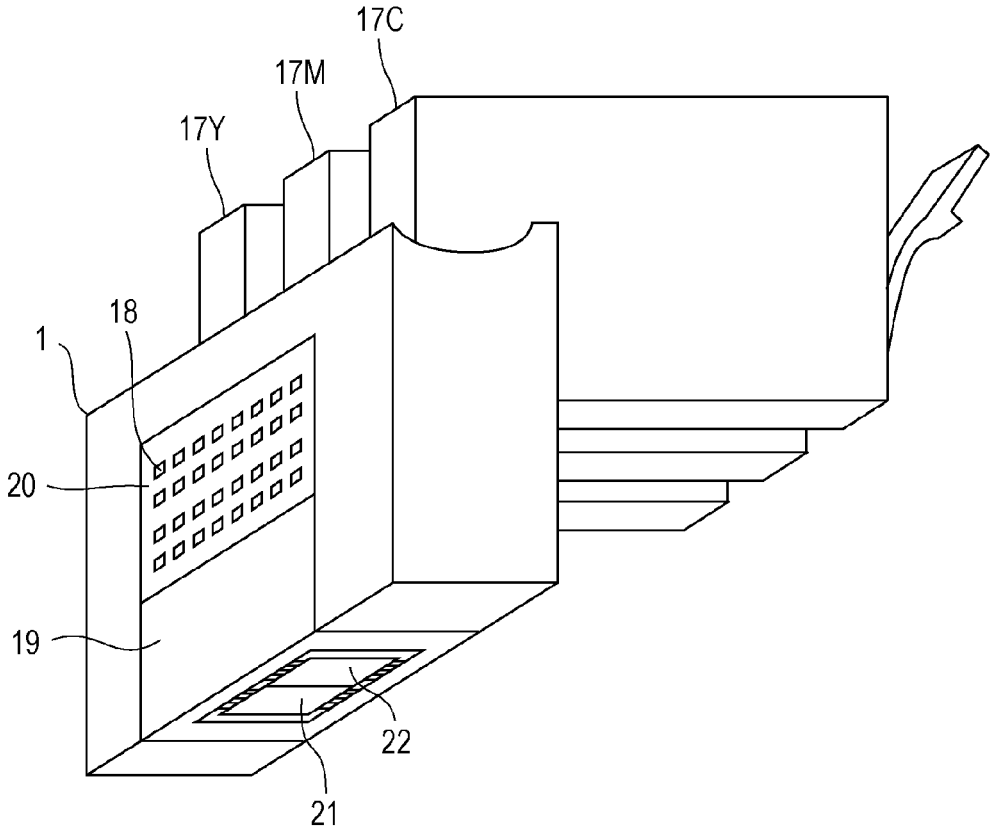
FIG. 3 shows a schematic configuration of the entire inkjet recording head according to the first embodiment of the present invention.

FIG. 3 shows a schematic configuration of the entire recording head 1, and shows the recording head 1 and ink tanks 17C, 17M, and 17Y mounted on the recording head 1.

The recording head 1 receives a drive signal from the main body of the recording device 100 via contact pads 18 on a contact substrate 20. The drive signal is supplied to two recording element substrates, namely a first recording element substrate 21 (first element substrate) and a second recording element substrate 22 (second element substrate), via a wiring member 19 connected to the contact substrate 20. Energy generating elements in the first recording element substrate 21 and the second recording element substrate 22 are driven in accordance with the drive signal supplied to the recording element substrates 21 and 22 to discharge ink from the discharge ports.

The ink tanks 17C, 17M, and 17Y store cyan, magenta, and yellow inks, respectively, and supply ink to the first recording element substrate 21 and the second recording element substrate 22 provided in the recording head 1.

Figure 4:
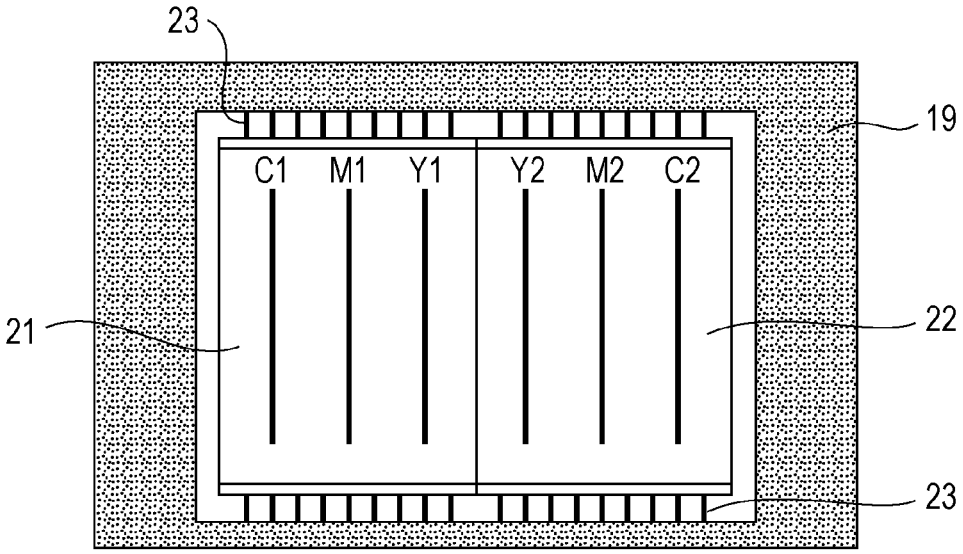
FIG. 4 is a schematic view showing the side of discharge ports of the inkjet recording head according to the first embodiment of the present invention.

FIG. 4 shows a schematic configuration of the side of the discharge ports of the recording head 1 on which the two recording element substrates 21 and 22 are mounted. The wiring member 19 and the first recording element substrate 21 and the second recording element substrate 22 are electrically connected to each other by leads 23 provided to the wiring member 19.

A cyan discharge port array C1 that discharges cyan ink, a magenta discharge port array M1 that discharges magenta ink, and a yellow discharge port array Y1 that discharges yellow ink are disposed on the first recording element substrate 21 to extend in parallel with respect to the main scanning direction in which the carriage 2 performs scanning. Likewise, a cyan discharge port array C2, a magenta discharge port array M2, and a yellow discharge port array Y2 are disposed on the second recording element substrate 22 to extend in parallel with respect to the main scanning direction.

The first recording element substrate 21 is configured such that the discharge port arrays C1, M1, and Y1 are disposed in this order from the left side of FIG. 4. Meanwhile, the second recording element substrate 22 is configured such that the discharge port arrays Y2, M2, and C2 are disposed in this order from the left side of FIG. 4. That is, the order of arrangement of colors of the discharge port arrays is opposite with respect to the scanning direction between the first recording element substrate 21 and the second recording element substrate 22.

Figure 5A:
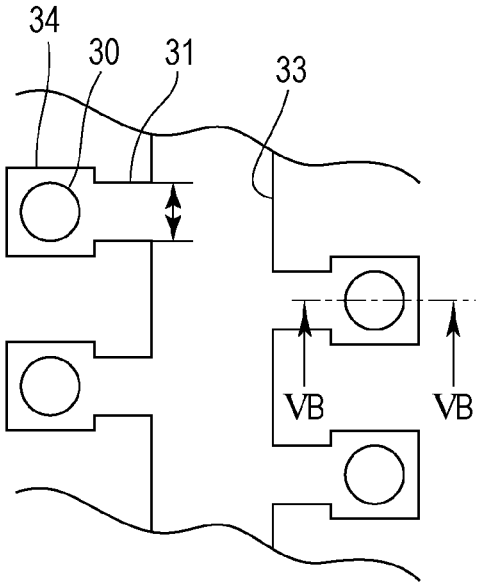
FIGS. 5A and 5B are a partial plan view and a cross-sectional view, respectively, showing the configuration of flow passages of the recording element substrate mounted on the inkjet recording head according to the present invention.
Figure 5B:
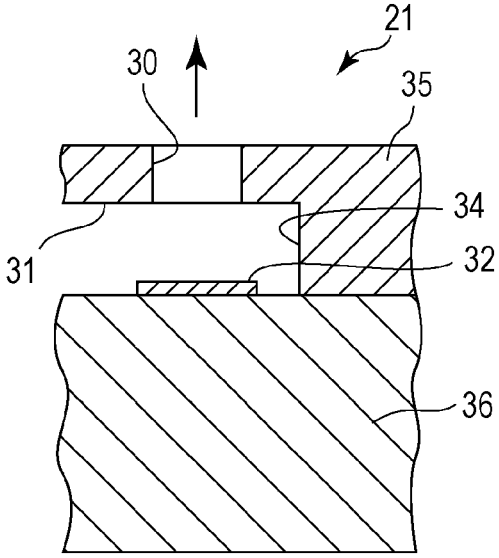

FIGS. 5A and 5B show the configuration of flow passages in the two recording element substrates 21 and 22. FIG. 5A is a partial plan view of a discharge port member 35 forming the recording element substrates 21 and 22 as seen from the side on which discharge ports 30 are provided. FIG. 5B is a cross-sectional view taken along the line VB-VB of FIG. 5A. The recording element substrates 21 and 22 include the discharge port member 35 in which the discharge ports 30 are formed, and a silicon substrate 36, on the upper surface of which heaters 32 serving as energy generating elements are provided.

The principle that ink is discharged from a discharge port will be described. Ink is supplied from a common liquid chamber 33 that communicates with an ink tank 17 onto a heater 32 serving as an energy generating element and provided in a pressure chamber 34 via an individual flow passage 31. The heater 32 is driven in accordance with the drive signal supplied to the recording element substrates 21 and 22. When driven, the entire heater 32 is heated rapidly. When the heater 32 is heated rapidly, film boiling occurs at the interface between the heater 32 and the ink, which abruptly pressurizes the ink. This pressurizing force causes the ink to be discharged vigorously from the discharge port 30 into the outside air. After the ink is discharged, the pressure chamber 34 is temporarily not filled with ink. However, the pressure chamber 34 is supplied with ink from the individual flow passage 31 in the course of time so that ink can be discharged again.

Figure 6:
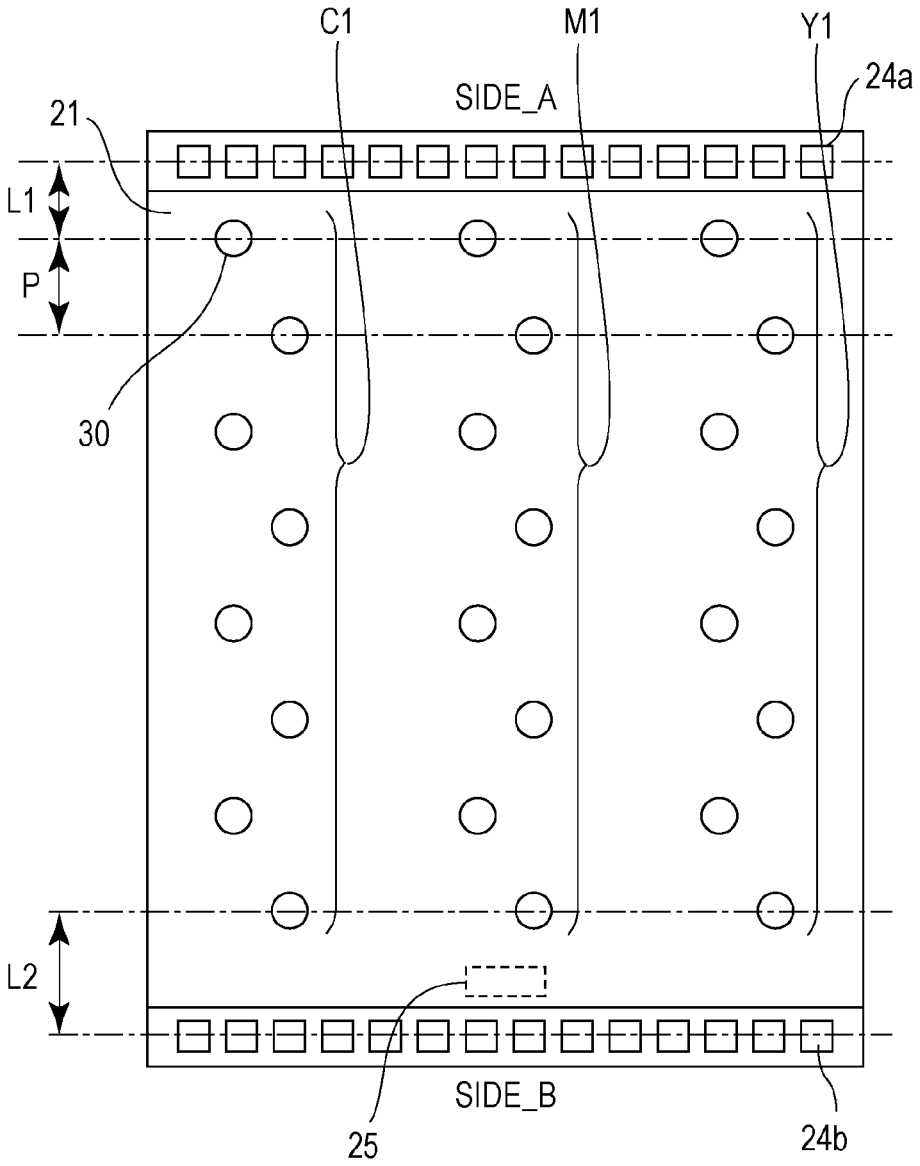
FIG. 6 illustrates the configuration of the recording element substrate mounted on the inkjet recording head according to the first embodiment of the present invention.

FIG. 6 illustrates the configuration of the first recording element substrate 21 mounted on the recording head 1. Because the second recording element substrate 22 has the same configuration as that of the first recording element substrate 21, the configuration of the recording element substrates will be described below using the first recording element substrate 21.

The discharge port arrays C1, M1, and Y1 provided on the first recording element substrate 21 are formed by a plurality of discharge ports 30 disposed at equal intervals of a pitch P, which is the distance between the centers of gravity of the discharge ports 30. The center of gravity of each discharge port 30 corresponds to the center of gravity of a figure having the shape of the discharge port 30.

The recording element substrate 21 is provided with electric contacts 24 to which the leads 23 (see FIG. 4) provided to the wiring member 19 are to be jointed. The heaters 32 of the recording element substrate 21 are driven on the basis of the drive signal sent from the recording device 100 external to the recording head 1 via the electric contacts 24. The electric contacts 24 are arranged linearly along the peripheral sides of the recording element substrate 21, which is rectangular, at both end portions of the recording element substrate 21 in the direction in which the discharge ports 30 in the discharge port arrays are disposed. Preferably, the plurality of electric contacts 24 are generally equal in area, and disposed such that the centers of gravity of the plurality of electric contacts 24 are arranged on a line.

One of the two sides along which the electric contacts 24 are arranged is defined as SIDE_A, and the other of the two sides is defined as SIDE_B. The electric contacts 24 provided on SIDE_A are referred to as "electric contacts 24*a*" (first electric contacts). The electric contacts 24 provided on SIDE_B are referred to as "electric contacts 24*b*" (second electric contacts). The distance between the center of gravity of the electric contacts 24*a* and the center of gravity of the discharge ports 30 provided at an end portion of the discharge port arrays on the side of the electric contacts 24*a* in the direction of arrangement in which the discharge ports 30 are disposed is defined as L1. The distance between the center of gravity of the electric contacts 24*b* and the center of gravity of the discharge ports 30 provided at an end portion of the discharge port arrays on the side of the electric contacts 24*b* in the direction of arrangement of the discharge ports 30 is defined as L2. Then, the distance L1 is smaller than the distance L2.

A diode 25 serving as a temperature detecting element is provided in the vicinity of SIDE_B, on which the distance between the discharge ports 30 and the electric contacts 24 is larger. The diode 25 is connected to a detection circuit of the main body of the recording device 100 via the electric contacts 24 to output a detected value (voltage value) in response to application of a detection signal (application of a constant current). The main body of the recording device 100 calculates the temperature of the recording head 1 from the detected value, and temporarily stops a recording operation in the case where the temperature of the recording head 1 is high at a predetermined temperature or more.

Figure 1:
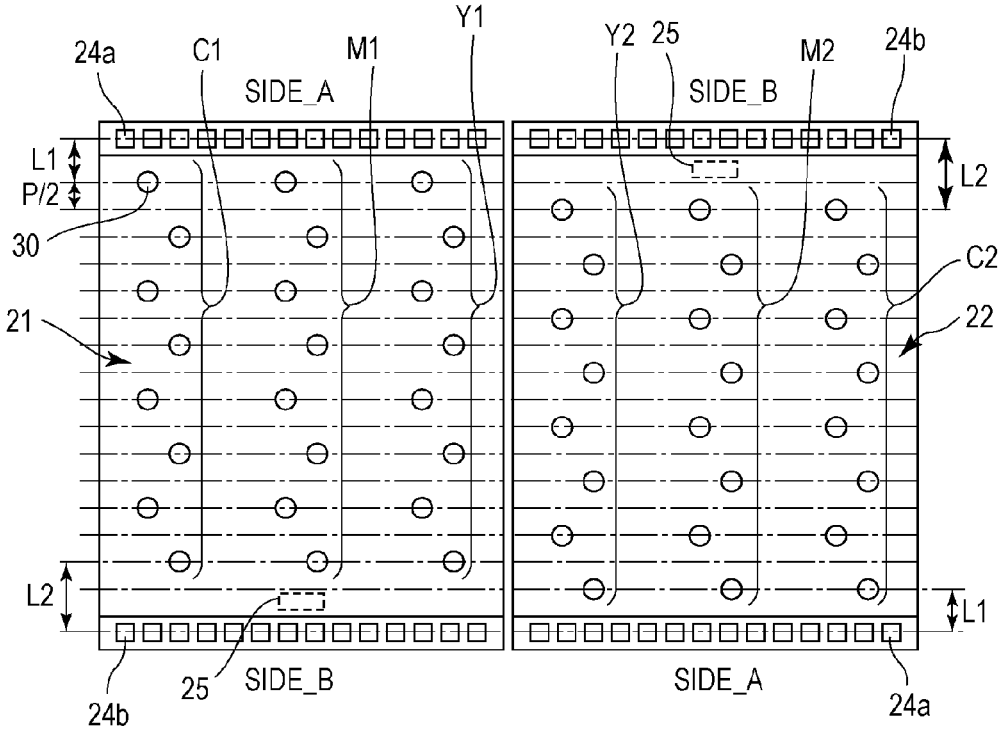
FIG. 1 shows recording element substrates mounted on an inkjet recording head according to a first embodiment of the present invention.

FIG. 1 shows the arrangement of the first recording element substrate 21 and the second recording element substrate 22 on the recording head 1 according to the first embodiment.

The first recording element substrate 21 and the second recording element substrate 22 are mounted side by side on the recording head 1 such that SIDE_A and SIDE_B of the recording element substrates 21 and 22 are inverted.

As discussed above, each of the first recording element substrate 21 and the second recording element substrate 22 is configured such that the distance between the electric contacts 24 and the discharge ports 30 on one side of the recording element substrate is different from the distance between the electric contacts 24 and the discharge ports 30 on the other side of the recording element substrate as seen from the side of the recording element substrate on which the discharge ports 30 are disposed. Thus, the discharge port arrays C1, M1, and Y1 on the first recording element substrate 21 and the discharge port arrays C2, M2, and Y2 on the second recording element substrate 22 enable interpolation of the discharge ports 30 for corresponding colors. This allows the discharge ports 30 to be disposed with a higher density, which enables high quality recording.

The electric contacts 24 provided on the first recording element substrate 21 and the second recording element substrate 22 can be disposed linearly. This enables the electric contacts 24 of the first recording element substrate 21 and the second recording element substrate 22 to be jointed using the leads 23 with lengths that are slightly different from or substantially the same as each other. This also reduces variations in joint area between the leads 23 and the electric contacts 24 at the joint portions, which reduces variations in joint strength at the joint portions to improve the joint reliability.

In FIG. 1, the distance L1 between the center of gravity of the electric contacts 24*a* and the center of gravity of the discharge ports 30 on SIDE_A and the distance L2 between the center of gravity of the electric contacts 24*b* and the center of gravity of the discharge ports 30 on SIDE_B satisfy the relationship L2=L1+P/2. That is, the discharge port arrays on the first recording element substrate 21 and the discharge port arrays on the second recording element substrate 22 are displaced from each other by half the pitch (P/2), which is more desirable.

The first recording element substrate 21 and the second recording element substrate 22 are mounted on the recording head 1 so as to be inverted with respect to each other. Therefore, the two diodes 25 are disposed diagonally on the recording head 1. This allows detection of the temperature over a wider range in an area in which the first recording element substrate 21 and the second recording element substrate 22 are mounted.

An increase in size of the recording element substrates can be suppressed by using a plurality of divided recording element substrates, which enables a reduction in manufacturing cost.

Further, the first recording element substrate 21 and the second recording element substrate 22 have the same configuration. Therefore, recording element substrates taken from the same wafer in the manufacturing process can be mounted on the same recording head 1. Recording element substrates in the same wafer have been manufactured under the same conditions, and therefore are hardly different in shape from each other. Therefore, the discharge port arrays on the first recording element substrate 21 and the second recording element substrate 22 tend to have the same discharge characteristics, which makes it possible to provide better recording images. The recording element substrates with the same configuration in the embodiment should only have the same arrangement of the discharge port arrays, and manufacturing errors may be tolerated.

Figure 7:
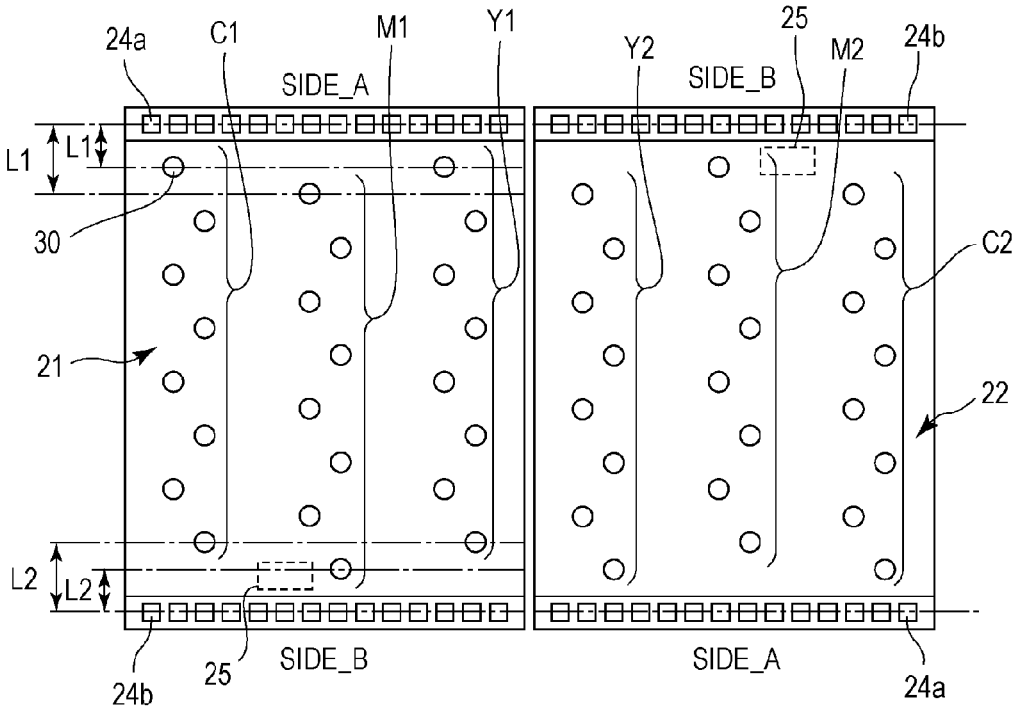
FIG. 7 shows a modification of the recording element substrates mounted on the inkjet recording head according to the first embodiment of the present invention.

FIG. 7 shows a modification of the embodiment. In the embodiment shown in FIG. 1, the distance L1 is equal among the discharge port arrays C1, M1, and Y1, and the distance L2 is equal among the discharge port arrays C1, M1, and Y1. That is, the distance L1 in a first discharge port array is equal to the distance L1 in a second discharge port array, and the distance L2 in the first discharge port array is equal to the distance L2 in the second discharge port array. In the modification shown in FIG. 7, on the other hand, the distance L1 for the discharge port array C1 is equal to the distance L1 for the discharge port array Y1, but the distance L1 for the discharge port array M1 is larger than the distance L1 for the discharge port arrays C1 and Y1. That is, the distance L1 in a first discharge port array is different from the distance L1 in a second discharge port array, and the distance L2 in the first discharge port array is different from the distance L2 in the second discharge port array. In the embodiment, as described above, it is only necessary that the distance L1 and the distance L2 should be different from each other for each of the discharge port arrays, and the present invention is not limited to a configuration in which the distance L1 is equal for the discharge port arrays and in which the distance L2 is equal for the discharge port arrays.

Figure 12A:
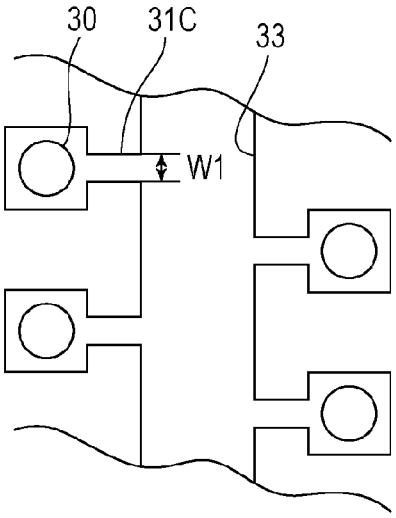
FIGS. 12A to 12C show a modification of the recording element substrate according to the present invention.
Figure 12B:
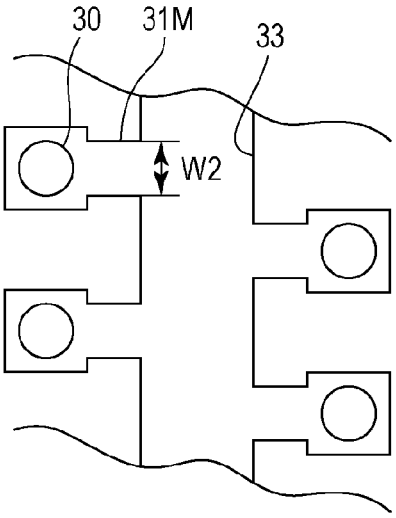
Figure 12C:
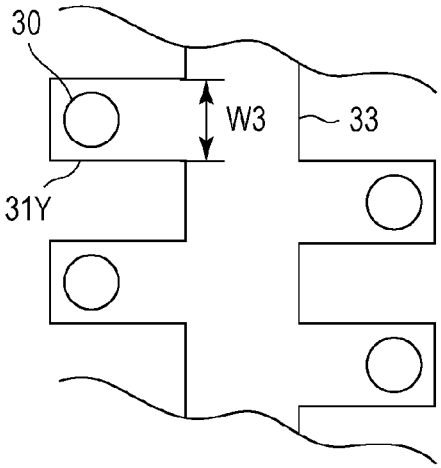

The width of each individual flow passage 31 may be set in accordance with the type of ink, as in a modification shown in FIGS. 12A to 12C. FIGS. 12A to 12C show the configuration of the flow passages for cyan, magenta, and yellow inks, respectively. The ink viscosity is the highest for yellow ink, the second highest for magenta ink, and the lowest for cyan ink. Thus, in order to reduce variations in speed of supply of inks with different viscosities to the pressure chambers 34, the width of the individual flow passage 31 may be the largest (W3) for yellow ink, the second largest (W2) for magenta ink, and the smallest (W1) for cyan ink. Since the two recording element substrates are inverted with respect to each other, the recording head can be manufactured using recording element substrates with the same configuration also in the case where the width of the flow passage is different among the discharge port arrays.

Second Embodiment

Next, a recording head according to a second embodiment in which the configuration of the discharge port arrays provided on the recording element substrates is different from that according to the first embodiment will be described.

Although the recording head 1 according to the second embodiment is similar to the schematic configuration of the recording head 1 according to the first embodiment shown in FIG. 3, the colors of inks in the ink tanks mounted on the recording head 1 are different from those according to the first embodiment. Specifically, ink tanks 17C, 17M, 17Y, and 17K are mounted on the recording head 1 according to the second embodiment. The ink tanks 17C, 17M, 17Y, and 17K store cyan, magenta, yellow, and black inks, respectively, and supply ink to the first recording element substrate 21 and the second recording element substrate 22 provided in the recording head 1.

Figure 8:
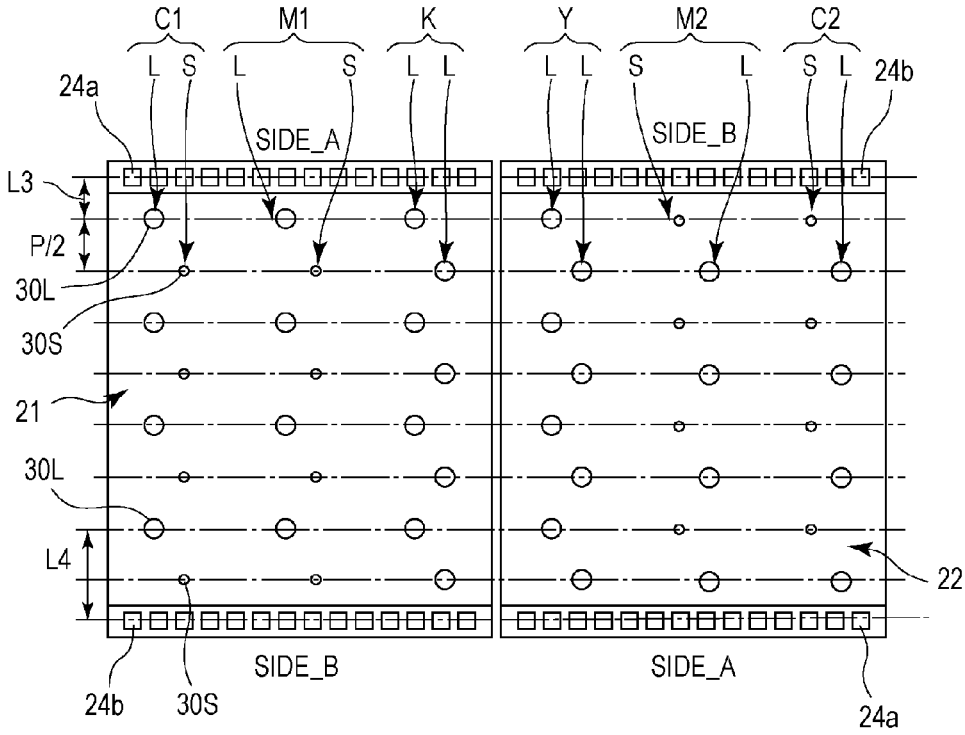
FIG. 8 shows recording element substrates mounted on an inkjet recording head according to a second embodiment of the present invention.

FIG. 8 shows the arrangement of the first recording element substrate 21 and the second recording element substrate 22 on the recording head 1 according to the second embodiment.

In the embodiment, as in the embodiment discussed above, the first recording element substrate 21 and the second recording element substrate 22 are mounted side by side such that SIDE_A and SIDE_B of the recording element substrates 21 and 22 are inverted.

The configuration of the recording element substrate according to the embodiment will be described. The first recording element substrate 21 is configured such that a cyan discharge port array C1 that discharges cyan ink, a magenta discharge port array M1 that discharges magenta ink, and a black discharge port array K that discharges black ink are disposed in this order from the left side of FIG. 8 to extend in parallel with respect to the main scanning direction. Meanwhile, the second recording element substrate 22, which is inverted with respect to the first recording element substrate 21, is configured such that a yellow discharge port array Y that discharges yellow ink, a magenta discharge port array M2, and a cyan discharge port array C2 are disposed in this order from the left side of FIG. 8 to extend in parallel with respect to the main scanning direction. In the embodiment, the discharge ports 30 are disposed in a staggered arrangement to form the discharge port arrays.

One of the discharge port arrays disposed in a staggered arrangement and forming each of the discharge port arrays C1 and C2 and M1 and M2, which respectively discharge cyan ink and magenta ink, is formed as a small discharge port array S, in which discharge ports with a small diameter are arranged, in order to discharge a small amount of ink. Cyan ink and magenta ink contribute much to achieving high-definition images such as photographs. Therefore, a small discharge port array S including discharge ports with a relatively small diameter to discharge a small amount of ink is provided for cyan ink and magenta ink. Meanwhile, the other of the discharge port arrays disposed in a staggered arrangement and forming each of the cyan discharge port arrays C1 and C2 and the magenta discharge port arrays M1 and M2 is formed as a large discharge port array L including discharge ports with a relatively small diameter. The discharge port arrays Y and K, which respectively discharge yellow ink and black ink, are each formed by large discharge port arrays L, in which discharge ports with a relatively large diameter are disposed, in order to discharge a large amount of ink.

The first recording element substrate 21 and the second recording element substrate 22 are mounted on the recording head 1 such that SIDE_A and SIDE_B of the recording element substrates 21 and 22 are inverted. Thus, the order of arrangement of the discharge port arrays is line-symmetric between the two recording element substrates 21 and 22. That is, the order of arrangement of the discharge port arrays is L, S, L, S, L, and L from the left of FIG. 8 for the first recording element substrate 21, and L, L, S, L, S, and L from the left of FIG. 8 for the second recording element substrate 22.

In the cyan discharge port arrays C1 and C2 and the magenta discharge port arrays M1 and M2, the distance between the center of gravity of the electric contacts 24*a* on SIDE_A and the center of gravity of large discharge ports 30L provided at an end portion of each discharge port array on the side of the electric contacts 24*a* in the direction of arrangement of the discharge ports 30 is defined as L3. Meanwhile, the distance between the center of gravity of the electric contacts 24*b* on SIDE_B and the center of gravity of large discharge ports 30L provided at an end portion of each discharge port array on the side of the electric contacts 24*b* in the direction of arrangement of the discharge ports 30 is defined as L4. Then, the distance L3 is smaller than the distance L4. This also applies to small discharge ports. The distance between the center of gravity of the electric contacts 24 and the center of gravity of small discharge ports 30S provided at an end of each discharge port array is different between SIDE_A and SIDE_B.

Accordingly, the large discharge ports 30L in the large discharge port arrays L in the cyan discharge port array C1 and the magenta discharge port array M1 on the first recording element substrate 21 are interpolated by the large discharge ports 30L in the large discharge port arrays L in the cyan discharge port array C2 and the magenta discharge port array M2 on the second recording element substrate 22. Likewise, the small discharge ports 30S in the small discharge port arrays S in the cyan discharge port array C1 and the magenta discharge port array M1 on the first recording element substrate 21 are interpolated by the small discharge ports 30S in the small discharge port arrays S in the cyan discharge port array C2 and the magenta discharge port array M2 on the second recording element substrate 22.

In FIG. 8, the distance L3 and the distance L4 satisfy the relationship L4=L3+P/2 for the large discharge port arrays L. Meanwhile, the distance L3 and the distance L4 satisfy the relationship L3=L4+P/2 for the small discharge port arrays S. That is, the large discharge port arrays L and the small discharge port arrays S on the first recording element substrate 21 and the second recording element substrate 22 are displaced from each other by half the pitch (P/2), which is more desirable.

As in the first embodiment, the electric contacts 24 provided on the first recording element substrate 21 and the second recording element substrate 22 can be disposed linearly.

Third Embodiment

Subsequently, a recording head according to a third embodiment in which the configuration of the wiring member 19 is different from that according to the embodiments discussed above will be described. In the embodiment, the configuration of the discharge port arrays is not specifically limited. Thus, the embodiment is described using a recording element substrate with discharge port arrays configured in the same way as those on the recording element substrate according to the first embodiment.

Figure 9:
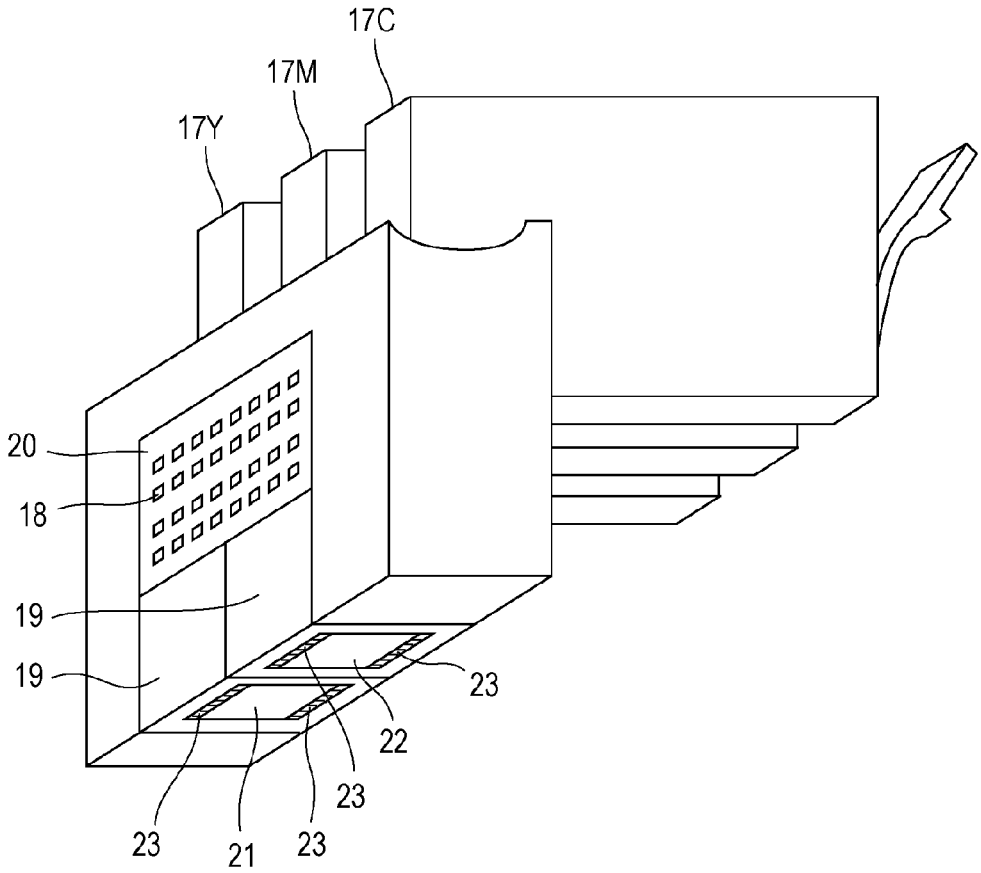
FIG. 9 shows a schematic configuration of the entire inkjet recording head according to a third embodiment of the present invention.

FIG. 9 shows a schematic configuration of the entire recording head 1 according to the third embodiment, and shows the recording head 1 and ink tanks 17C, 17M, and 17Y mounted on the recording head 1.

The recording head 1 receives a drive signal from the main body of the recording device 100 via contact pads 18 on a contact substrate 20. The drive signal is supplied to the first recording element substrate 21 and the second recording element substrate 22 via two wiring members 19 connected to the contact substrate 20. The two wiring members 19 have the same configuration as each other in the type of wirings disposed therein, the order of arrangement of the wirings, the position of the opening inside which the recording element substrates are to be disposed, and so forth.

The wiring members 19 and the recording element substrates 21 and 22 are electrically connected to each other by the leads 23. Heaters serving as energy generating elements in the recording element substrates 21 and 22 are driven in accordance with the supplied drive signal to discharge ink from the discharge ports 30.

Figure 11:
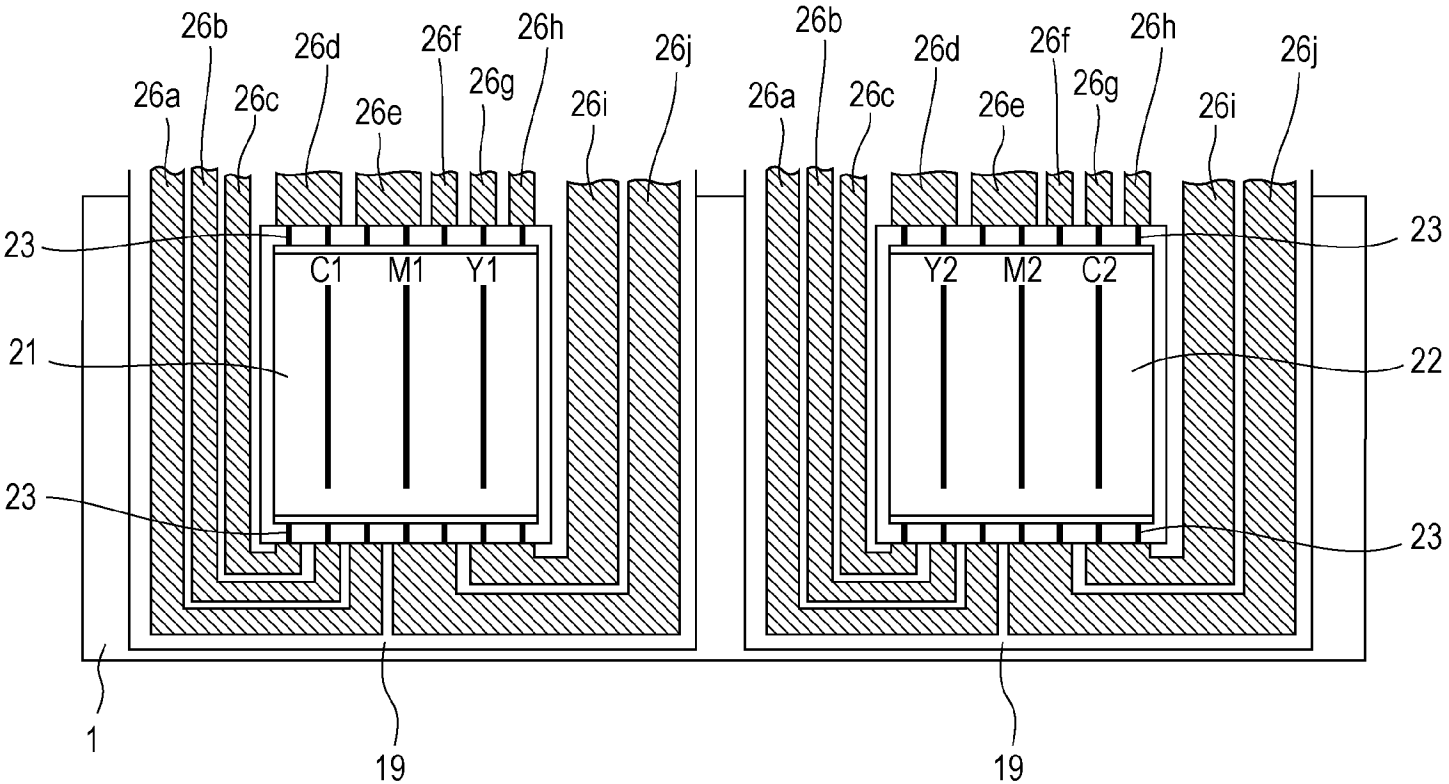
FIG. 11 shows the configuration of the recording element substrates and wiring members according to the third embodiment of the present invention.

As shown in FIG. 11, the widths of wirings 26*a* to 26*j* provided inside the wiring members 19 are different from each other depending on the type of the drive signal. That is, a relatively high current is applied to the wirings 26*d*, 26*e*, 26*i*, and 26*j* for VH and GH, which are drive power sources for the heaters, compared to the other wirings. Thus, the wirings 26*d*, 26*e*, 26*i*, and 26*j* have a larger width to reduce the wiring resistance and suppress a voltage drop during drive.

Figure 10:
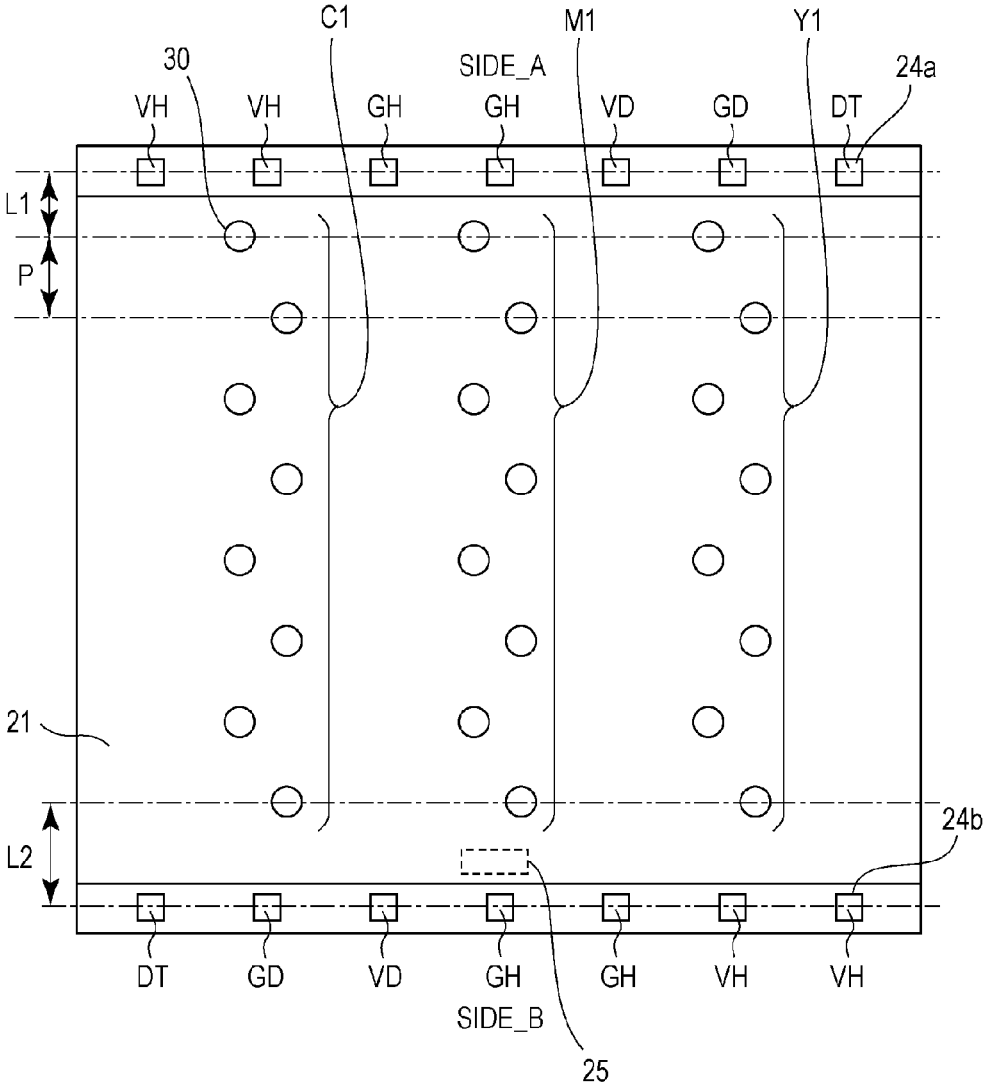
FIG. 10 illustrates the configuration of a recording element substrate according to the third embodiment of the present invention.

FIG. 10 shows the internal configuration of the first recording element substrate 21 according to the third embodiment. Because the second recording element substrate 22 has the same configuration as that of the first recording element substrate 21 as in the embodiments discussed above, the configuration of the recording element substrates will be described using the first recording element substrate 21.

The first recording element substrate 21 is provided with electric contacts 24 to which the leads 23 provided to the wiring member 19 are to be jointed. A plurality of electric contacts 24 are disposed linearly at both end portions of the first recording element substrate 21 in the direction of arrangement of the discharge ports 30. The plurality of electric contacts 24 include a plurality of types of electric contacts 24 that receive different types of input signals. Example of the types of drive signals input to the first recording element substrate 21 via the electric contacts 24 include a heater drive power source (VH) and a ground (GH), a data signal power source (VD) and a ground (GD), and a data signal (DT).

The order of arrangement of the plurality of types of electric contacts 24 provided in correspondence with the types of the drive signals is opposite between SIDE_A and SIDE_B so that the order of arrangement on SIDE_A from the left of FIG. 10 coincides with the order of arrangement on SIDE_B from the right of FIG. 10. That is, the electric contacts 24 are disposed in the order of VH, VH, GH, GH, VD, GD, and DT on SIDE_A from the left of FIG. 10, and disposed in the order of VH, VH, GH, GH, VD, GD, and DT on SIDE_B from the right of FIG. 10.

As in the embodiments discussed above, the first recording element substrate 21 and the second recording element substrate 22 have the same configuration, and are mounted side by side so as to be inverted vertically with respect to each other (such that SIDE_A and SIDE_B in FIG. 10 are inverted). Because recording element substrates on which the order of arrangement of the electric contacts 24 is opposite between SIDE_A and SIDE_B are used, the order of arrangement of the electric contacts 24 is the same between the first recording element substrate 21 and the second recording element substrate 22 as mounted on the recording head 1.

This enables use of wiring members 19 with the same configuration as the two wiring members 19 to be connected to the first recording element substrate 21 and the second recording element substrate 22.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-293008 filed Dec. 28, 2010, which is hereby incorporated by reference herein in its entirety.

What is claimed is:

1. A liquid discharge head comprising:

a first element substrate and a second element substrate, the first element substrate and the second element substrate including:

a discharge port array in which a plurality of discharge ports that discharge liquid are disposed;

a plurality of energy generating elements that generate energy for discharging liquid from the plurality of discharge ports; and a plurality of electric contacts electrically connected to the plurality of energy generating elements, the plurality of electric contacts including a plurality of first electric contacts disposed linearly along one end of the first element substrate and the second element substrate in a direction of arrangement in which the plurality of discharge ports are disposed, and a plurality of second electric contacts disposed linearly along the other end of the first element substrate and the second element substrate in the direction of arrangement, the first element substrate and the second element substrate being configured such that a distance between a center of gravity of the first electric contacts and a center of gravity of the discharge port provided at an end portion of the discharge port array on a side of the first electric contacts in the direction of arrangement is different from a distance between a center of gravity of the second electric contacts and a center of gravity of the discharge port provided at an end portion of the discharge port array on a side of the second electric contacts in the direction of arrangement, wherein the plurality of first electric contacts of the first element substrate and the plurality of second electric contacts of the second element substrate are disposed linearly, and the plurality of second electric contacts of the first element substrate and the plurality of first electric contacts of the second element substrate are disposed linearly.

2. The liquid discharge head according to claim 1, wherein the plurality of discharge ports are disposed at a pitch P, and defining the distance between the center of gravity of the first electric contacts and the center of gravity of the discharge port provided at the end portion of the discharge port array on the side of the first electric contacts in the direction of arrangement as L1 and defining the distance between the center of gravity of the second electric contacts and the center of gravity of the discharge port provided at the end portion of the discharge port array on the side of the second electric contacts in the direction of arrangement as L2, a relationship of L2=L1+P/2 is satisfied.

3. The liquid discharge head according to claim 1, wherein a plurality of the discharge port arrays includes a first discharge port array and a second discharge port array, and the distance between the center of gravity of the first electric contacts and the center of gravity of the discharge port provided at the end portion of the first discharge port array on the side of the first electric contacts in the direction of arrangement is equal to the distance between the center of gravity of the first electric contacts and the center of gravity of the discharge port provided at the end portion of the second discharge port array on the side of the first electric contacts in the direction of arrangement, and the distance between the center of gravity of the second electric contacts and the center of gravity of the discharge port provided at the end portion of the first discharge port array on the side of the second electric contacts in the direction of arrangement is equal to the distance between the center of gravity of the second electric contacts and the center of gravity of the discharge port provided at the end portion of the second discharge port array on the side of the second electric contacts in the direction of arrangement.

4. The liquid discharge head according to claim 1, wherein a plurality of discharge port arrays includes a first discharge port array and a second discharge port array, and the distance between the center of gravity of the first electric contacts and the center of gravity of the discharge port provided at the end portion of the first discharge port array on the side of the first electric contacts in the direction of arrangement is different from the distance between the center of gravity of the first electric contacts and the center of gravity of the discharge port provided at the end portion of the second discharge port array on the side of the first electric contacts in the direction of arrangement, and the distance between the center of gravity of the second electric contacts and the center of gravity of the discharge port provided at the end portion of the first discharge port array on the side of the second electric contacts in the direction of arrangement is different from the distance between the center of gravity of the second electric contacts and the center of gravity of the discharge port provided at the end portion of the second discharge port array on the side of the second electric contacts in the direction of arrangement.

5. A liquid discharge head comprising:

a first element substrate and a second element substrate, the first element substrate and the second element substrate including:

a plurality of discharge port arrays in which a plurality of discharge ports that discharge liquid are disposed, the plurality of discharge port arrays including a discharge port array in which large discharge ports with a relatively large diameter and small discharge ports with a relatively small diameter are disposed in a staggered arrangement;

a plurality of energy generating elements that generate energy for discharging liquid from the plurality of discharge ports; and a plurality of electric contacts electrically connected to the plurality of energy generating elements, the plurality of electric contacts including a plurality of first electric contacts disposed linearly along one end of the first element substrate and the second element substrate in a direction of arrangement in which the plurality of discharge ports are disposed, and a plurality of second electric contacts disposed linearly along the other end of the first element substrate and the second element substrate in the direction of arrangement, the first element substrate and the second element substrate being configured such that a distance between a center of gravity of the first electric contacts and a center of gravity of the large discharge port provided at an end portion of the discharge port array on a side of the first electric contacts in the direction of arrangement is different from a distance between a center of gravity of the second electric contacts and a center of gravity of the large discharge port provided at an end portion of the discharge port array on a side of the second electric contacts in the direction of arrangement, wherein the plurality of first electric contacts of the first element substrate and the plurality of second electric contacts of the second element substrate are disposed linearly, and the plurality of second electric contacts of the first element substrate and the plurality of first electric contacts of the second element substrate are disposed linearly.

6. The liquid discharge head according to claim 5, wherein the large discharge ports and the small discharge ports are disposed in a staggered arrangement in the discharge port array that discharges cyan ink and the discharge port array that discharges magenta ink, and the large discharge ports are disposed in a staggered arrangement in the discharge port array that discharges black ink and the discharge port array that discharges yellow ink.

7. The liquid discharge head according to claim 1, wherein the first element substrate and the second element substrate are provided with a temperature detecting element that detects a temperature and that is provided either between the first electric contacts and the discharge port provided at the end portion of the discharge port array on the side of the first electric contacts in the direction of arrangement or between the second electric contacts and the discharge port provided at the end portion of the discharge port array on the side of the second electric contacts in the direction of arrangement.

8. The liquid discharge head according to claim 1, wherein the distance between the center of gravity of the first electric contacts and the center of gravity of the discharge port provided at the end portion of the discharge port array on the side of the first electric contacts in the direction of arrangement is smaller than the distance between the center of gravity of the second electric contacts and the center of gravity of the discharge port provided at the end portion of the discharge port array on the side of the second electric contacts in the direction of arrangement, and the first element substrate and the second element substrate are provided with a temperature detecting element that detects a temperature and that is provided between the second electric contacts and the discharge port provided at the end portion of the discharge port array on the side of the second electric contacts in the direction of arrangement.

9. The liquid discharge head according to claim 1, wherein the plurality of first electric contacts and the plurality of second electric contacts include a plurality of types of electric contacts to which different types of signals are input, and an order of arrangement of the plurality of types of electric contacts is opposite between the plurality of first electric contacts and the plurality of second electric contacts.

10. The liquid discharge head according to claim 1, wherein the first element substrate and the second element substrate include a supply port that supplies liquid to be discharged from the discharge ports, pressure chambers in which the energy generating elements are provided, and flow passages that connect the supply port and the pressure chambers to each other, a plurality of the discharge port arrays includes a first discharge port array and a second discharge port array, and a width of the flow passages that communicate with the discharge ports in the first discharge port array is different from a width of the flow passages that communicate with the discharge ports in the second discharge port array.

* * * * *